US005506002A

United States Patent [19]

Maitra et al.

[11] Patent Number: 5,506,002

[45] Date of Patent: Apr. 9, 1996

[54] METHOD FOR GALVANIZING LINEAR MATERIALS

[75] Inventors: Kalyan K. Maitra, Flossmoor; Carl H. Unger, Oak Lawn, both of Ill.

[73] Assignee: Allied Tube & Conduit Corporation, Harvey, Ill.

[21] Appl. No.: 431,481

[22] Filed: May 1, 1995

Related U.S. Application Data

[63] Continuation of Ser. No. 287,856, Aug. 9, 1994, abandoned.

[51] Int. Cl.[6] ..... B05D 1/30

[52] U.S. Cl. ..... 427/420; 427/431; 148/242; 148/579; 148/705

[58] Field of Search ..... 427/420, 431; 148/242, 705, 579

[56] References Cited

U.S. PATENT DOCUMENTS

| | | | |
|---|---|---|---|
| 1,263,858 | 4/1918 | Cole | 118/405 |
| 1,531,730 | 3/1925 | Bundy | 118/405 |
| 3,122,114 | 2/1964 | Krengel et al. | 113/33 |
| 3,226,817 | 1/1966 | Simborg et al. | 29/430 |
| 3,259,148 | 7/1966 | Krengel et al. | 138/145 |
| 3,620,805 | 11/1971 | Martin | 117/51 |
| 3,877,975 | 4/1975 | Raymond | 427/420 |
| 3,956,537 | 5/1976 | Raymond | 427/433 |
| 4,082,869 | 4/1978 | Raymond | 427/357 |
| 4,107,370 | 8/1978 | Ingraham | 428/247 |
| 4,254,158 | 3/1981 | Fukuzuka et al. | 427/8 |
| 4,304,822 | 12/1981 | Heyl | 428/623 |
| 4,814,210 | 3/1989 | Ackermann et al. | 427/433 |
| 5,035,042 | 7/1991 | Maitro et al. | 427/433 |

FOREIGN PATENT DOCUMENTS

| | | | |
|---|---|---|---|
| 2647814 | 12/1990 | France | C23L 2/00 |
| 2105661 | 8/1972 | Germany . | |
| 1546635 | 5/1979 | United Kingdom | C23L 1/14 |
| WO90/15166 | 12/1990 | WIPO | C23L 2/00 |
| WO90/15279 | 12/1990 | WIPO | F16K 31/06 |

*Primary Examiner*—Benjamin Utech
*Attorney, Agent, or Firm*—Banner & Allegretti, Ltd.

[57] ABSTRACT

A method of galvanizing ferrous linear elements, e.g., tube, pipe, structural shapes, as part of a continuous manufacturing line by passing the axially travelling preheated element through transversely flowing molten zinc.

10 Claims, 3 Drawing Sheets

METHOD FOR GALVANIZING LINEAR MATERIALS

This application is a continuation of application Ser. No. 08/287,856, filed Aug. 9, 1994, now abandoned.

This invention relates to a continuous process for incrementally galvanizing linear materials such as wire, rod, tube, or pipe, by passing them through a transversely flowing stream of molten zinc.

BACKGROUND OF THE INVENTION

The galvanization of the exterior surface of pipe or conduit as part of the continuous manufacture thereof from an endless strip of sheet metal has been practiced commercially for a number of years. The process basically consists of roll-forming the metal strip into tubular form after drawing it from an endless supply, welding the seam, scarfing and dressing off the weld, and passing the continuously formed tube through a pickling bath and rinse. The tube is then passed through a preheating station and then through a bath of molten zinc, after which the excess zinc is removed, the tube cooled to handling temperature in a water bath, and the tube sheared into finite lengths. The tube may be subjected to a sizing operation after being cooled, prior to the shearing operation.

Such an integrated continuous manufacturing process is disclosed, for example, in U.S. Pat. No. 3,226,817, with particular emphasis on the galvanization step of the process in U.S. Pat. Nos. 3,226,817, 3,259,148, and 3,877,975.

In the galvanizing stations of such prior integrated processes, the continuously-formed, rapidly moving tube, after appropriate preparation, was passed through an elongated trough positioned above a pool of molten zinc in a large vat, from which a stream of the liquid metal was pumped to maintain a substantial and overflowing body of molten zinc in the trough as well as to replace the zinc being carried away from the trough as a fluid coating on the tube.

As described in co-pending application Ser. No. 07/892,432, filed Jun. 10, 1992, assigned to the same assignee as the present application, it has recently been found that coating of linear elements in a continuous galvanizing process may be effected by immersion of the linear elements in molten zinc in an open-ended tube, to which the zinc is pumped with zinc flowing out of the opposite ends of the tube. This arrangement enables galvanizing to be accomplished with reduced zinc flow as compared with prior methods employing overflowing troughs. Reduction of zinc flow is generally desirable due to the consequent reduction of the corrosive and abrasive effects of molten zinc on the zinc pump and other system components.

In a further development described and claim in subsequent U.S. patent application Ser. No. 08/026,432, filed Mar. 4, 1993, now U.S. Pat. No. 5,364,661, issued Nov. 15, 1994 and assigned to the same assignee as the present application molten zinc was applied to the linear element, specifically a tube, by passing it concentrically through a surrounding and converging conical curtain of flowing molten zinc issuing from the orifice of an encircling nozzle.

More recently, the practicality of galvanizing linear elements by simply passing them through a transversely flowing stream of molten zinc has been established.

SUMMARY OF THE INVENTION

In the course of the development of the abbreviated immersion system of our co-pending application Ser. No. 07/892,432, the open-ended, T-head galvanizing tube was mounted on a gooseneck on the riser pipe from the zinc pump. Supported in that way, i.e., to receive the downwardly flowing zinc from the gooseneck of the riser pipe, the arrangement encountered unexpected erosive effects from the flowing zinc. As a result, the galvanizing tube separated from the gooseneck of the riser pipe, and was carried by the through-running workpiece to the end of the zinc vat where the workpiece exited the zinc vat. The surprising discovery from this mishap was that the galvanizing coat was in all respects satisfactory except on the top surface of the workpiece which was scraped where it had supported the errant galvanizing tube. That is to say, the galvanizing coat received by the workpiece when simply passing through the downwardly directed zinc stream was in all respects satisfactory except where it had been scraped by the otherwise unsupported galvanizing tube.

This discovery has been refined in the preferred form of the invention in which the zinc stream is flared into a transverse, flowing curtain, and in alternative forms which provide a homing horizontal component to the flow of zinc to assist the natural forces of adhesion in accomplishing the coating of larger diameter linear elements.

As with the conical curtain flow of co-pending application Ser. No. 08/026,432, the flow of molten zinc originates at the zinc pump and is delivered upwardly through a riser pipe from which it issues in a free-flowing stream. Upon cessation of pump operation, the riser pipe quickly drains downwardly to the level of molten zinc in the vat.

BRIEF DESCRIPTION OF THE DRAWINGS

The invention is described in reference to the accompanying drawings, in which.

DETAILED DESCRIPTION OF THE PREFERRED EMBODIMENT

Figure 1:
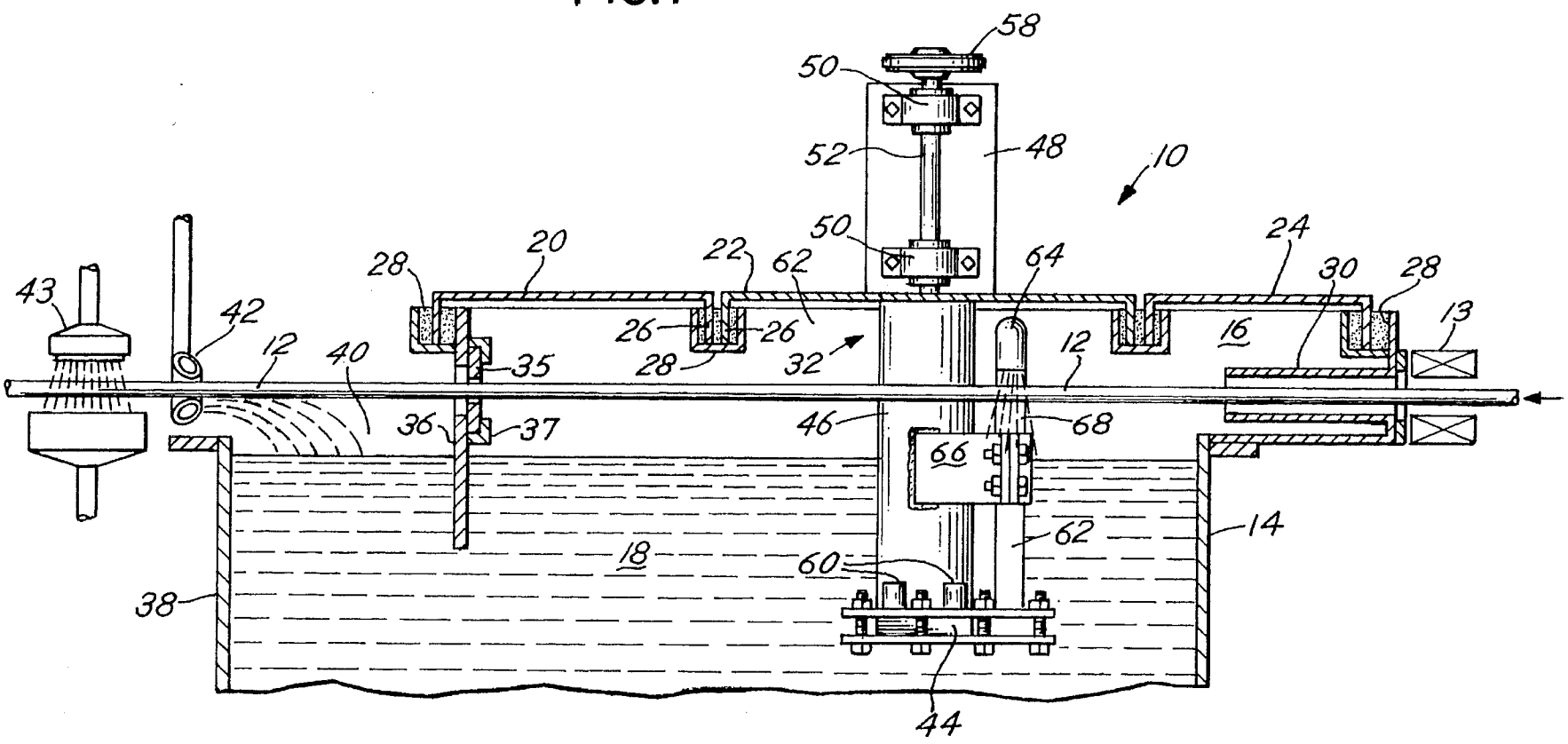
FIG. 1 is a diagrammatic, longitudinally sectioned elevational view of a galvanizing station in accordance with the invention, as installed in an integrated line for the continuous manufacture of galvanized steel tube or pipe.
Figure 2:
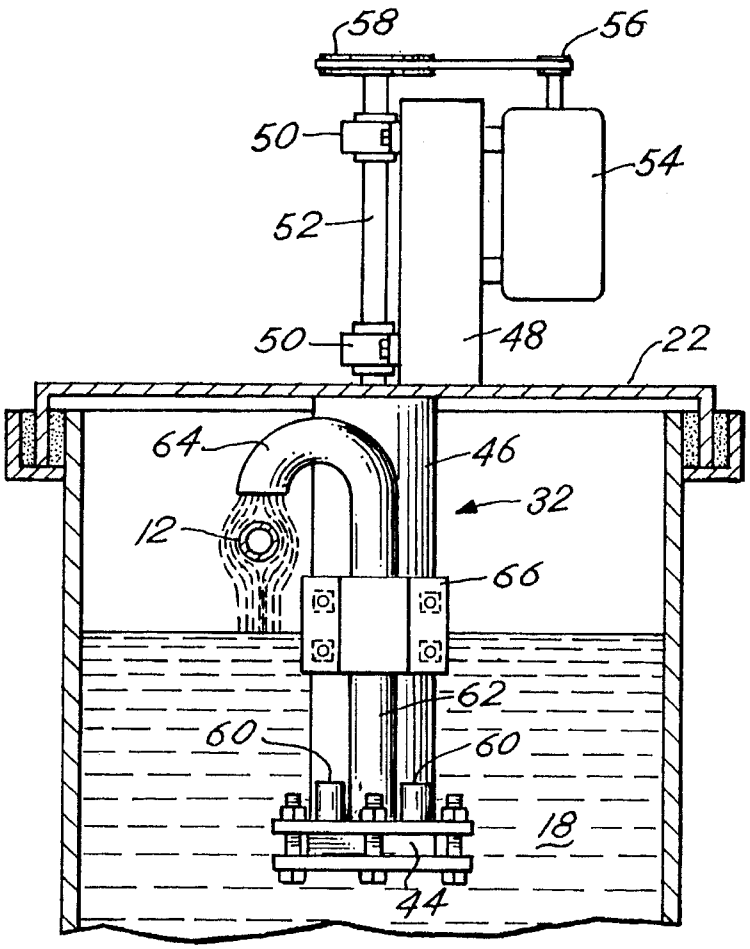
FIG. 2 is a transverse sectional view of the apparatus of FIG. 1, and shown on an enlarged scale.

Referring to FIGS. 1 and 2 for a general description of the method and apparatus of the invention, FIG. 1 shows a galvanizing station 10 in a system for the continuous manufacture of galvanized pipe or conduit 12. While the method and apparatus illustrated were developed in the stated context, the invention is believed applicable as well to the continuous galvanization of other iron or steel linear elements such as wire, rod, or structural shapes.

The conduit 12 passes through the galvanizing station from right to left as viewed in FIG. 1, delivered in rapid axial motion from a roll-forming station where an endless band of metal is progressively rolled into tubular form with abutting edges which are closed by an electrically welded seam which is scarfed and dressed en route to the galvanizing station. In preparation for galvanizing, the conduit is first cleaned by a pickling bath of acid, followed by a neutralizing rinse, after which the tube is preheated in an inert gas atmosphere immediately before entry into the galvanizing station. Preheating is conveniently accomplished by passing the conduit axially through an induction heating coil 13. As these pregalvanizing steps are well understood in the art, they are not here shown, reference simply being made to the Krengel U.S. Pat. No. 3,259,148, in which one such system is illustrated and described.

The galvanizing station 10 comprises an elongated vat 14 of molten zinc constructed in generally rectangular form of welded steel plate and formed to provide a space 16 above the predetermined level of the pool 18 of liquid zinc therein, maintained in molten condition at about 850° F., i.e., about 50° F. above the melting point of zinc. While the zinc may be maintained at any temperature above its melting point, it is preferred that its temperature not exceed 900° F., where unlined steel vats and pumps are used, due to the increased wear of apparatus contacting zinc at temperatures over 900° F. Higher temperatures may be used where ceramic-lined equipment is employed. The heating means (not shown) may be gas or oil burners directed against the walls of the vat or electric induction heaters.

Generally, it is desirable to preheat the tube to a temperature approximately as high as that of the molten zinc to be applied to the tube. Under certain circumstances, for example, where oil is present on the tubing, it may be desirable to preheat the tube to temperatures as much as 100° F. greater than that of the molten zinc.

In the illustrated embodiment, the space 16 above the pool of liquid zinc is closed by a series of covers 20, 22, and 24 having downwardly extending perimeter flanges 26 which are received in troughs 28 extending around the periphery of the vat and transversely of the vat, as well, to permit the use of multiple covers for convenient access to the interior of the vat for maintenance purposes. Fewer covers or more covers may be employed in other embodiments. The troughs 28 in which the cover flanges are received are partially filled with a granular material, such as sand, or with fibrous ceramic wool, which forms a retarding barrier to the escape of the inert gas with which the space 16 above the molten zinc is filled and maintained slightly above atmospheric pressure to prevent, or at least limit, the entry of air into that space.

As earlier noted, the conduit 12 enters the galvanizing station from the right immediately from the preheater, the housing for which is normally abutted against the entering end of the galvanizing station with an intervening packing of mineral wool or the like to limit the entrainment of ambient air into the galvanizing zone above the molten metal. The conduit enters the station 10 through a hole in the vat wall and thence through a larger tube 30 intended to bring the conduit into more intimate contact with the inert purging gas. The tube then passes through the galvanizing apparatus 32 of the invention and exits the galvanizing zone through an aligned hole 34 in the far wall 36 of the space. A plate 35 having an opening therein which is similar in shape to, and only slightly larger than, the cross-section of the linear element 12, provides initial wiping and support for the linear element 12 adjacent the hole 34. The plate 35 is supported on a bracket 37 which permits easy installation and removal of the plate. For linear elements of different sizes or shapes, different plates 35 having holes of corresponding sizes and shapes may be used.

It will be noted that the far wall 36 of the space is positioned above and extends downwardly into the pool 18 of molten zinc at some distance removed from the end wall 38 of the vat proper, providing a small area 40 of open access to the pool of zinc through which the inventory of molten zinc is maintained by the periodic addition of pigs of the metal. That open area also serves the further purpose of receiving the molten zinc trimmed from the outer surface of the conduit 12 by an air knife 42 which delivers a cutting stream of compressed air through an annular nozzle aperture onto the surface of the conduit to trim the excess zinc therefrom, propelling the same in a flat trajectory onto the exposed area 40 of the pool of molten zinc. A quenching water bath 43 downstream of the air knife cools and freezes the zinc coating.

Generally, it is desirable to maximize the linear velocity of the workpiece 12 during the operation. However, the linear velocity that may be achieved is, as a practical matter, subject to limitations imposed by various aspects of the galvanizing process. In one embodiment of the invention, the velocity of the linear element 12 is about 600 feet per minute. In other embodiments, the linear elements may be advanced at greater or lesser speeds which may be in the range of 90–1000 feet per minute.

The galvanizing apparatus 32 is shown mounted on the central vat cover 22. It comprises a submersible centrifugal pump 44 secured as by welding to the lower end of a thick-walled mounting pipe 46 welded to the underside of the vat cover. Supporting structure 48 mounted on the upper side of the cover 22 provides two bearings 50 for the vertical shaft 52 of the pump, which is driven at its upper end from a variable speed, vertical electrical motor 54 by a V-belt entrained on a pair of speed-reducing pulleys 56 and 58. At its lower end, there is keyed onto the shaft 52 a double-sided pump impeller (not shown) which when rotating draws the molten zinc from the pool through a central intake in the bottom plate of the pump and a similar central hole in the top plate of the pump, through which the shaft 52 passes with wide clearance to admit the zinc to the upper impeller blades. Access by the liquid zinc to the upper central opening is provided by ports 60 in the supporting structure between the upper plate of the pump and the mounting pipe 46. The mounting pipe 46 completely shrouds the pump shaft from the inert gas in the space 16, eliminating the need for shaft seals between the shaft 52 and cover 22 to prevent the escape of the gas.

The pump delivers the molten zinc to a riser pipe 62 which carries the liquid metal upwardly and which may, in some forms of the invention, be bent in a 180° reversal, or gooseneck 64, and in any case may be further modified or fitted at its delivery end to shape the flowing stream 68 of molten zinc issuing therefrom. To support the riser pipe 62, a pair of brackets 66, welded to the mounting pipe 46 of the pump, encircle the riser pipe in a split-block configuration in which the two parts of bracket are secured together by screws.

Figure 3:
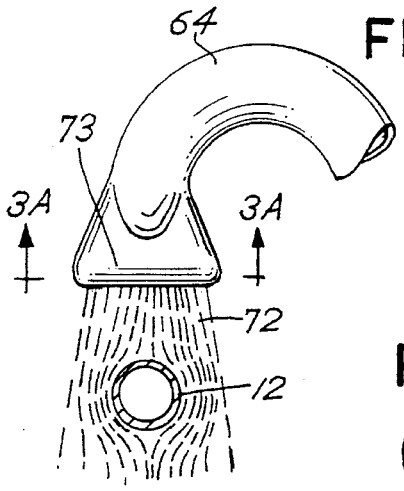
FIG. 3 is an enlarged end view of a zinc-stream delivery pipe in accordance with the invention.
Figure 3A:
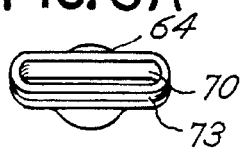
FIG. 3A is a sectional view of the delivery pipe taken on line A—A of FIG. 3.

While, as earlier indicated, the stream of molten zinc descending from the end of a simple gooseneck produced a satisfactory result on the pipe being run when the mishap occurred in which the T-head immersion galvanizer of application Ser. No. 07/892,432 became detached from the gooseneck, the delivery end of the goose-neck is preferably flattened to a slot opening 70, as shown in FIGS. 3 and 3A, so as to deliver a wider, thinner stream of molten zinc as a flat curtain 72 wider than, and disposed transversely of, the through-running pipe 12. The wider curtain of molten zinc has the dual benefit of assuring that an adequate supply of zinc descends along both sides of the workpiece pipe, as well as accommodating a wider range of pipe sizes.

In addition, we prefer to provide a slight bend 73 of say 20° to 30° in the gooseneck 64 to give the descending fan of molten zinc a directional component axially of and running with the flow of the workpiece tube or pipe through the apparatus. This can be done in any convenient way, as by bending the flattened and flared end portion of the goose-neck, as shown in FIGS. 3 and 3A.

Figure 7:
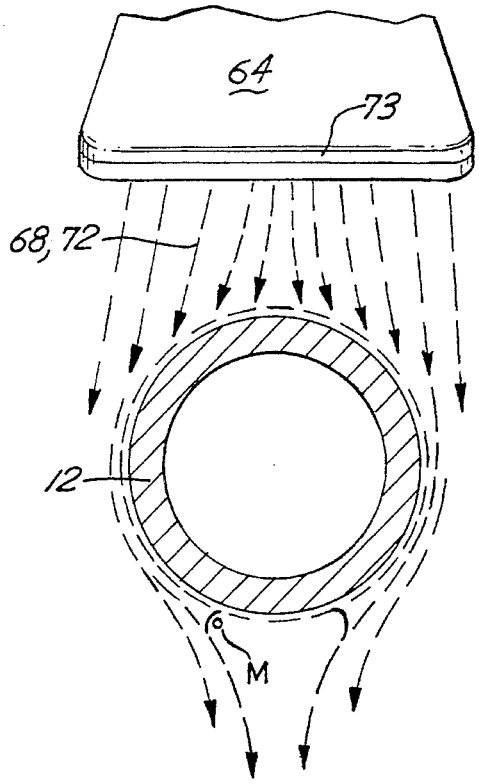
FIG. 7 is a cross-section of the tubular workpiece in a down-flowing stream of molten zinc.

FIG. 7 illustrates what occurs as the zinc stream flows downwardly around the workpiece pipe. The interfacial attraction of the molten zinc for the surface of the hot steel pipe 12 carries a film of zinc around the underside of the workpiece pipe to complete the coating about the entire periphery. The excess zinc falls away from the coating film in a meniscus at point M in the diagram of FIG. 7.

Figure 8:
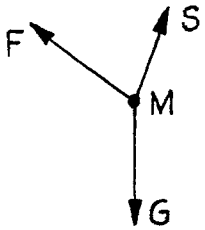
FIG. 8 is a diagram of the principle external forces acting upon the molten zinc coating at point M in FIG. 7.

The force diagram of FIG. 8 illustrates what are believed to be the principal forces acting upon the molten zinc at the break-away meniscus when the stream of zinc is delivered from above. These forces are the surface tension or cohesive force S acting generally radially and seeking to hold the excess zinc to the adhering film, the force of gravity G pulling the excess zinc downwardly, and the force of "friction" F, actually also the cohesive force of the zinc film acting upon the excess zinc axially of the workpiece pipe as the pipe hauls the molten zinc in the direction of workpiece movement through the galvanizing station.

The transverse curtain 72 of downwardly flowing zinc has been used successfully to galvanize steel tube/pipe in sizes up to two-and-one-half inches, and it has not been ascertained whether there is an upper limit of size. It is conceivable, however, that as the cross-sectional radius of curvature of the workpiece pipe increases, there may be an upper limit of workpiece size beyond which a unidirectionally flowing stream, whether cylindrical or flat curtain, cannot deliver the molten zinc to the opposite side of the pipe.

Figure 4:
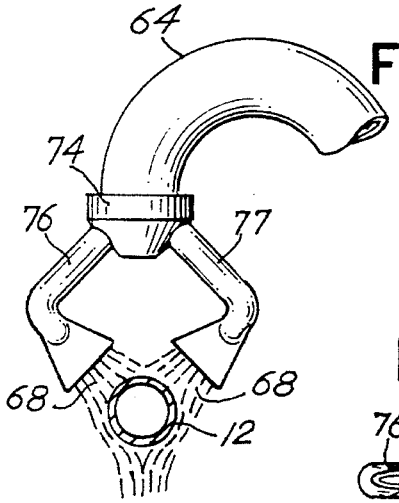
FIG. 4 is an enlarged end view of an alternative delivery pipe in accordance with a modified embodiment of the invention.
Figure 4A:
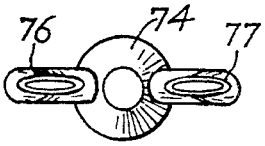
FIG. 4A is a bottom view of the same.

For such cases, the arrangement of FIGS. 4 and 4A is envisioned, i.e., a division of the zinc flow into two lesser streams 68 focussed upon the work piece from opposite sides thereof so as to have inward as well as downward directional components to assure the coating of the underside of the pipe. The FIG. 4 arrangement employs a Y-adapter in the form of a conical cap 74 at the delivery end of the gooseneck 64, from which two horns or pipe elbows 76, 77 emerge to direct separate fan-shaped streams 68 obliquely at the workpiece pipe 12 to enable their opposing flows to reach the underside of the pipe.

Figure 5:
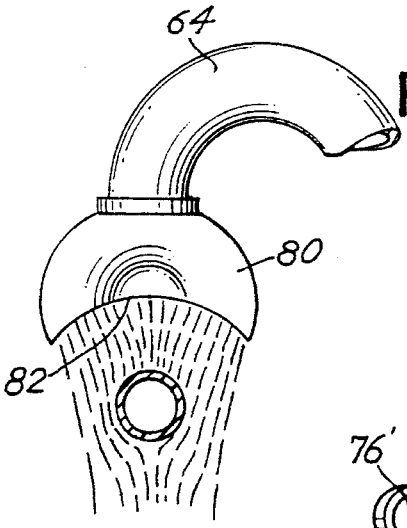
FIG. 5 is an enlarged end view of a further alternative delivery pipe.
Figure 5A:
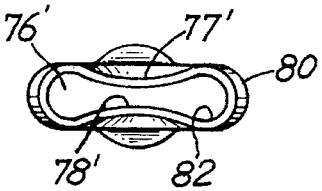
FIG. 5A is a bottom view of the same.

The arrangement of FIGS. 5 and 5A is to effect similar to that of FIG. 4, but with both flows combined in a single flow-directing nozzle 80 shaped to provide inward as well as downward direction to the stream of zinc. That is, the housing of the nozzle 80 is crescent-shaped and the mid-portion compressed to define two arcuate major paths 76' and 77' separated by a narrowly constricted central path 78'. The major paths terminate with an inward as well as downward directional component while the restricted central flow is essentially downward. The nozzle opening 82 (FIG. 5A) takes the form of a centrally compressed oval.

Irrespective of which of these forms of molten zinc stream is employed, an intermetallic alloy layer begins to form between the hot ferrous substrate and the molten zinc as soon as the workpiece pipe 12 is wetted by the zinc. The thickness and composition of the intermetallic alloy layer are affected by the length of the reaction time (i.e., the period of time during which the zinc in liquid phase contacts the surface of the pipe) as well as by the temperature of the workpiece and of the molten zinc applied, and to some extent by the alloy composition of the zinc. Using the techniques here disclosed, satisfactory galvanization has been obtained with reaction times of less than one second at production rates of up to 600 feet per minute. Reaction time begins with the entry of any given workpiece increment into the stream or curtain of zinc, and ends essentially when the zinc coating on that increment is frozen and the substrate cooled by the quenching water bath 43.

In actual practice, using the transverse curtain form 72 of zinc stream in the stated temperature range of 850° F. to 900° F., intermetallic alloy layers will have a thickness in the range of from 0.1 to 0.3 mils and a zinc layer having a thickness of from 0.5 to 2 mils. These thicknesses are dependent for the most part on the speed of the line, which can range from 300 to 1000 feet per minute, depending on the wall thickness of the product in the case of pipe or tube. The preferred zinc composition will contain from 0.05% to 0.11% aluminum, which is to be taken to be encompassed by the term "zinc", as herein used.

To the extent hereinbefore described, the flow of zinc has been generally downward notwithstanding the utilization of a lateral directional component for large sizes of pipe or tube, and for different shapes of tube or other structural shapes which lend themselves to galvanizing "in line", i.e., as part of the overall manufacturing process.

The stream of zinc may, however, also be projected upwardly, as a fountain, to lend itself to the coating of most structural shapes, including downwardly-open shapes such as angles, C-shapes, and channels in addition to tubular shapes of various cross-sectional configuration.

Figure 6:
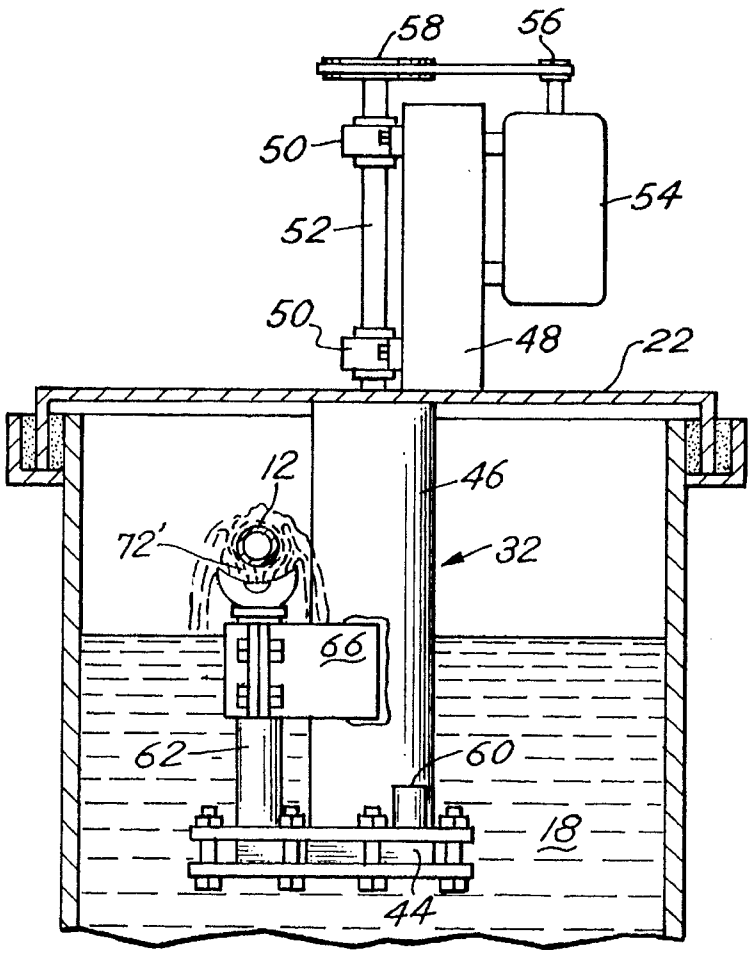
FIG. 6 is a transverse sectional view of the apparatus of FIG. 1 modified by rotation of the supporting column of the submersible zinc pump through a quarter turn to displace the riser pipe laterally to position it for use as a fountain.

The fountain arrangement is shown in FIG. 6, which shows the riser pipe without the gooseneck. Here it is believed preferable to use the nozzle 80 (FIGS. 5, 5A) to shape the projected stream 72' into a curtain arrayed across the path of the axially moving workpiece, and to provide the two principal portions of the flowing curtain, emerging from the sides of the nozzle opening, with inwardly directed components so as to arch over and fall back upon the workpiece.

Moreover, in many if not most of the usual structural shapes, the drag of the workpiece upon the rising, projected stream 72' of zinc will tend to draw it onto the upper surface of the workpiece, and the coating of the upper surface will be aided by the somewhat random fall-back of the molten zinc after its kinetic energy is spent.

The benefit from this form of exterior surface galvanizing in a continuously operating manufacturing line is that it eliminates the need for multiple sizes of nozzles and or nozzle apertures, where encircling nozzles have been used, or the need for multiple sizes of T-head galvanizing tubes, where that method is employed, when the manufacturing line is changed over to making pipe, tube, or other linear element of different size or shape. The freely flowing stream of zinc adapts itself to all sizes within limits.

Moreover, it retains the benefits experienced with the systems of our earlier patent applications identified, i.e., of eliminating the danger of flash-vaporizing retained water when imperfect seams reach the galvanizing station during line start-up, of much faster resumption of production following line change-overs due to the ready availability of the molten zinc by simply turning on the pump, and the same greatly reduced pumping requirement as compared with the trough galvanizing of linear elements produced in a continuous manufacturing line.

The features of the invention believed new and patentable are set forth in the appended claims.

What is claimed is:

1. A method of galvanizing a linear element composed of a ferrous metal by means of a pump, said method comprising:

providing an upwardly open reservoir of molten zinc;

maintaining an atmosphere of inert gas within an enclosed space above the surface of the molten zinc in said reservoir;

heating the linear element to be galvanized to a temperature at least as great as that of the molten zinc;

driving said heated linear element axially through an application zone located above said surface in said enclosed space;

pumping under pressure a stream of said molten zinc from said reservoir to a position at one side of said linear element adjacent said application zone:

projecting said stream unconstrained under pressure from said pump from said position through said application zone around the entire circumference of said linear element in quantity exceeding that which will adhere to said linear element, said stream being sufficiently short and rapid to preclude substantial solidification of said molten zinc due to cooling of said stream in said inert atmosphere; and allowing the excess and unadhered molten zinc to fall from said linear element onto the surface of the molten zinc in said reservoir, whereby said linear element is coated with zinc without requiring heating of said stream in said inert atmosphere and said excess and said unadhered molten zinc is returned to said reservoir.

2. The method of claim 1 wherein said step of projecting said stream comprises the step of allowing said stream to remain unconstrained after said stream has contacted said linear element and using surface tension to urge said stream to the side of said linear element opposite said one side.

3. The method of claim 1 wherein said step of projecting an unconstrained stream of molten zinc comprises the step of providing a downward component of force to said stream.

4. The method of claim 1 wherein said step of projecting an unconstrained stream of molten zinc comprises the step of providing an upward component of force to said stream.

5. The method of claim 1 wherein said step of projecting an unconstrained stream of molten zinc comprises the step of providing a lateral component of force and either an upward or a downward component of force to said stream.

6. The method of any of claims 1 to 5 wherein the molten zinc is projected as a transverse curtain wider than the transverse dimension of said linear element.

7. The method of claim 5 wherein said step of projecting an unconstrained stream of molten zinc comprises the step of projecting multiple distinct streams of said molten zinc converging upon the surface of said linear element.

8. The method of any of claims 1, 2, 3, 4, 5 and 7 in which the cooling step is preceded by stripping from said linear element an amount less than the total amount of molten zinc adhering thereto.

9. The method of claim 1 wherein said step of projecting an unconstrained stream comprises the step of pumping said molten zinc from said reservoir to a discharge point above said application zone.

10. The method of claim 1 wherein said pumping is conducted at a variable rate.

* * * * *